US007073589B2

(12) United States Patent
Tiernan et al.

(10) Patent No.: US 7,073,589 B2
(45) Date of Patent: Jul. 11, 2006

(54) SYSTEM FOR FRACTURING WELLS USING SUPPLEMENTAL LONGER-BURNING PROPELLANTS

(75) Inventors: John P. Tiernan, Newnan, GA (US); Richard S. Passamaneck, Golden, CO (US)

(73) Assignee: Propellant Fracturing & Stimulation, LLC, Peachtree City, GA (US)

( * ) Notice: Subject to any disclaimer, the term of this patent is extended or adjusted under 35 U.S.C. 154(b) by 177 days.

(21) Appl. No.: 10/348,809

(22) Filed: Jan. 22, 2003

(65) Prior Publication Data

US 2003/0155125 A1 Aug. 21, 2003

Related U.S. Application Data

(60) Provisional application No. 60/351,312, filed on Jan. 22, 2002.

(51) Int. Cl.
*E21B 43/263* (2006.01)
*F42D 3/04* (2006.01)
*F42B 3/04* (2006.01)

(52) U.S. Cl. ..... 166/308.2; 166/63; 166/177.5; 166/299; 175/71; 102/313; 102/318; 102/320

(58) Field of Classification Search ..... 175/2, 175/71, 65, 57, 46; 166/299, 305.1, 308.2, 166/63, 177.5, 308.1; 102/313, 318, 320
See application file for complete search history.

(56) References Cited

U.S. PATENT DOCUMENTS 3,690,106 A * 9/1972 Tregembo et al. ..... 405/266
4,039,030 A 8/1977 Godfrey et al.
4,081,031 A * 3/1978 Mohaupt ..... 166/299
4,091,870 A * 5/1978 Godfrey et al. ..... 166/299
4,160,412 A * 7/1979 Snyer et al. ..... 102/307
4,248,303 A * 2/1981 Charpentier ..... 166/299
4,329,925 A 5/1982 Hane et al.
4,633,951 A 1/1987 Hill et al.
4,681,643 A * 7/1987 Colgate et al. ..... 149/21
4,683,943 A 8/1987 Hill et al.
4,718,493 A 1/1988 Hill et al.
4,739,832 A * 4/1988 Jennings et al. ..... 166/299
4,798,244 A 1/1989 Trost
4,807,702 A * 2/1989 Jennings et al. ..... 166/299
4,976,318 A * 12/1990 Mohaupt ..... 166/311
5,005,641 A * 4/1991 Mohaupt ..... 166/63
5,295,545 A 3/1994 Passamaneck
5,551,344 A * 9/1996 Couet et al. ..... 102/312
5,765,923 A * 6/1998 Watson et al. ..... 299/13
2003/0155112 A1* 8/2003 Tiernan et al. ..... 166/63
2005/0056459 A1* 3/2005 Haney et al. ..... 175/4.6

* cited by examiner

*Primary Examiner*—Jennifer H. Gay
(74) *Attorney, Agent, or Firm*—Dorr, Carson & Birney, P.C.

(57) ABSTRACT

A system for fracturing wells uses a primary propellant charge to initially produce pressures within the well in excess of the maximum fracture extension pressure of the surrounding formation, but below that which would cause damage to the well. A supplemental propellant charge burns for a substantially longer period of time than the primary propellant charge, and thereby maintains pressures within the well in excess of the maximum fracture extension pressure for a significant period of time following completion of the primary propellant burn.

17 Claims, 3 Drawing Sheets

SYSTEM FOR FRACTURING WELLS USING SUPPLEMENTAL LONGER-BURNING PROPELLANTS

RELATED APPLICATION

The present application is based on, and claims priority to U.S. Provisional Patent Application Ser. No. 60/351,312, filed on Jan. 22, 2002.

BACKGROUND OF THE INVENTION

1. Field of the Invention

The present invention relates generally to the field of systems for fracturing the strata surrounding a well. More specifically, the present invention discloses a system for fracturing oil and gas wells using supplemental longer-burning propellants.

2. Statement of the Problem

Propellant fracturing has been used in the oil and gas for over 25 years with varying degrees of success. The burn time of most propellants have generally been very short (i.e., on the order of a few milliseconds to as much as 100 milliseconds). Such short burn times limit fracture propagation in the strata surrounding the well and increase the likelihood of damage to the well and the well casing. It is also more difficult to accurately model the combustion and fracturing processes in such a short time frame.

3. Prior Art

The prior art in the field of the present invention includes the following:

| Inventor | Patent No. | Issue Date |
|---|---|---|
| Passamaneck | 5,295,545 | Mar. 22, 1994 |
| Trost | 4,798,244 | Jan. 17, 1989 |
| Hill et al. | 4,718,493 | Jan. 12, 1988 |
| Hill et al. | 4,633,951 | Jan. 6, 1987 |
| Hill et al. | 4,683,943 | Aug. 4, 1987 |
| Hane et al. | 4,329,925 | May 18, 1982 |
| Godfrey et al. | 4,039,030 | Aug. 2, 1977 |

Passamaneck discloses a method of fracturing wells using propellants which burn radially inward in a predictable manner. A computer program is used to model the burn rate of the propellant to determine a suitable quantity and configuration of the propellant for creating multiple fractures in the surrounding formation.

Trost discloses a tool for radially fracturing the rock formation surrounding a well bore using a perforated cylindrical canister housing a stack of propellant modules.

The patents to Hill et al. disclose a fracturing system in which a cased well is initially filled with a compressible hydraulic fracturing fluid containing a mixture of liquid, compressed gas, and propant material. The fracturing fluid is precompressed in the well. The well casing is then perforated, which releases the precompressed fracturing fluid to fracture in the surrounding formation.

Hane et al. disclose an apparatus for explosive fracturing in which opposed end charges are detonated to enhance the explosive capability of a central explosive charge.

Godfrey et al. disclose a system for stimulating production in a well that is first filled with a fracturing fluid. A high-explosive charge is then suspended in the well adjacent to the pay zone. A propellant is suspended in the well above the high-explosive charge. The propellant is ignited first, followed by detonation of the high explosive. The purpose of the propellant is to maintain pressure caused by the high explosive over a longer period of time, thereby extending the fractures caused by the high explosive.

4. Solution to the Problem

In contrast to the prior art, the present invention employs a combination of a new ignition method and a propellant engineered to have longer burn times to produce burn times ranging from 400 milliseconds to several seconds. The present invention uses a propellant system that employees longer burns in combination with additional propellant placed above or below the primary propellant grain. The primary propellant has a burn time tailored so that the pressure remains above the maximum fracture extension pressure but not so large as to damage the well casing. The ignition of the primary propellant produces a pressure rise time that falls in the multiple fracture regime of the formation being fractured. The burn time for the primary propellant is from 400 milliseconds to approximately 1 second. However, the time that the propellant creates fractures parallel to the minimum stress plane is only 40 to 45% of the times mentioned above. The addition of supplemental propellant grains to sustain gas production after the primary propellant burn is complete allows the fracturing process to continue for durations of as long as 20 seconds. This approach allows fractures to continue their extension into the formation for times that are much longer than for a single propellant grain, thus increasing the effective fracture lengths and the corresponding effective well bore diameters.

SUMMARY OF THE INVENTION

This invention provides a system for fracturing wells that uses a primary propellant charge to initially produce pressures within the well in excess of the maximum fracture extension pressure of the surrounding formation, but below that which would cause damage to the well. A supplemental propellant charge burns for a substantially longer period of time than the primary propellant charge, and thereby maintains pressures within the well in excess of the maximum fracture extension pressure for a significant period of time following completion of the primary propellant burn.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
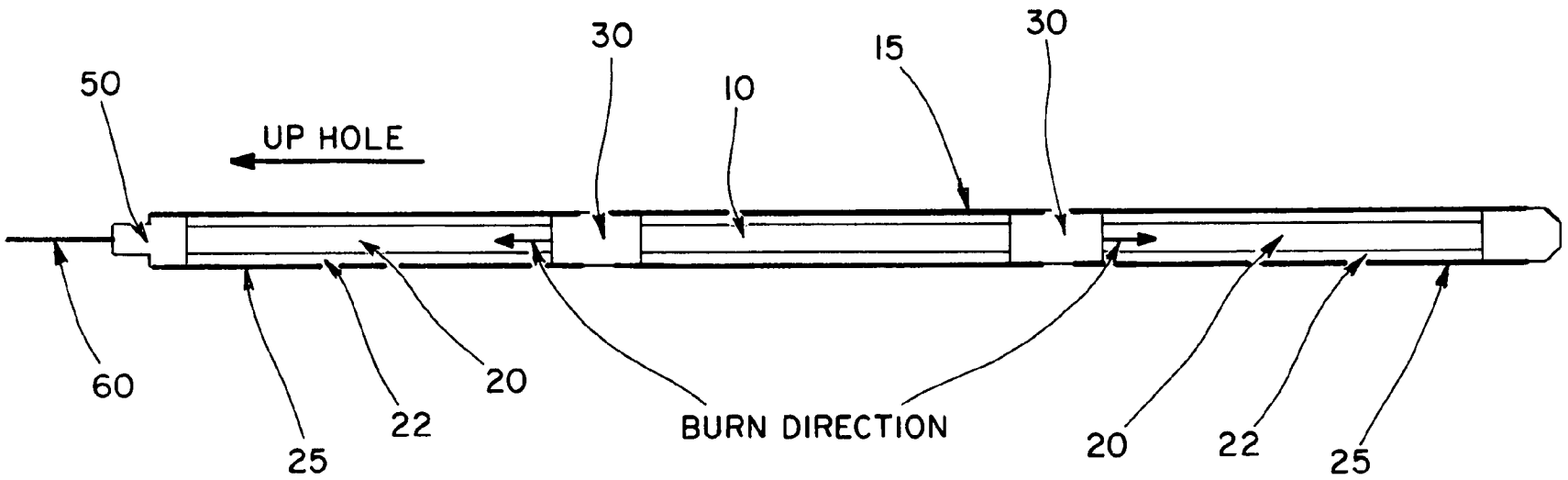
FIG. 1 is a cross-sectional view of the present invention.

Turning to FIG. 1, a cross-sectional view is provided of the present invention. The major components are a primary propellant charge 10 and a number of secondary propellant charges 20. Starting at the top is the wireline, coiled tubing, or pipe tubing 60 used to convey the system downhole.

Figure 2:
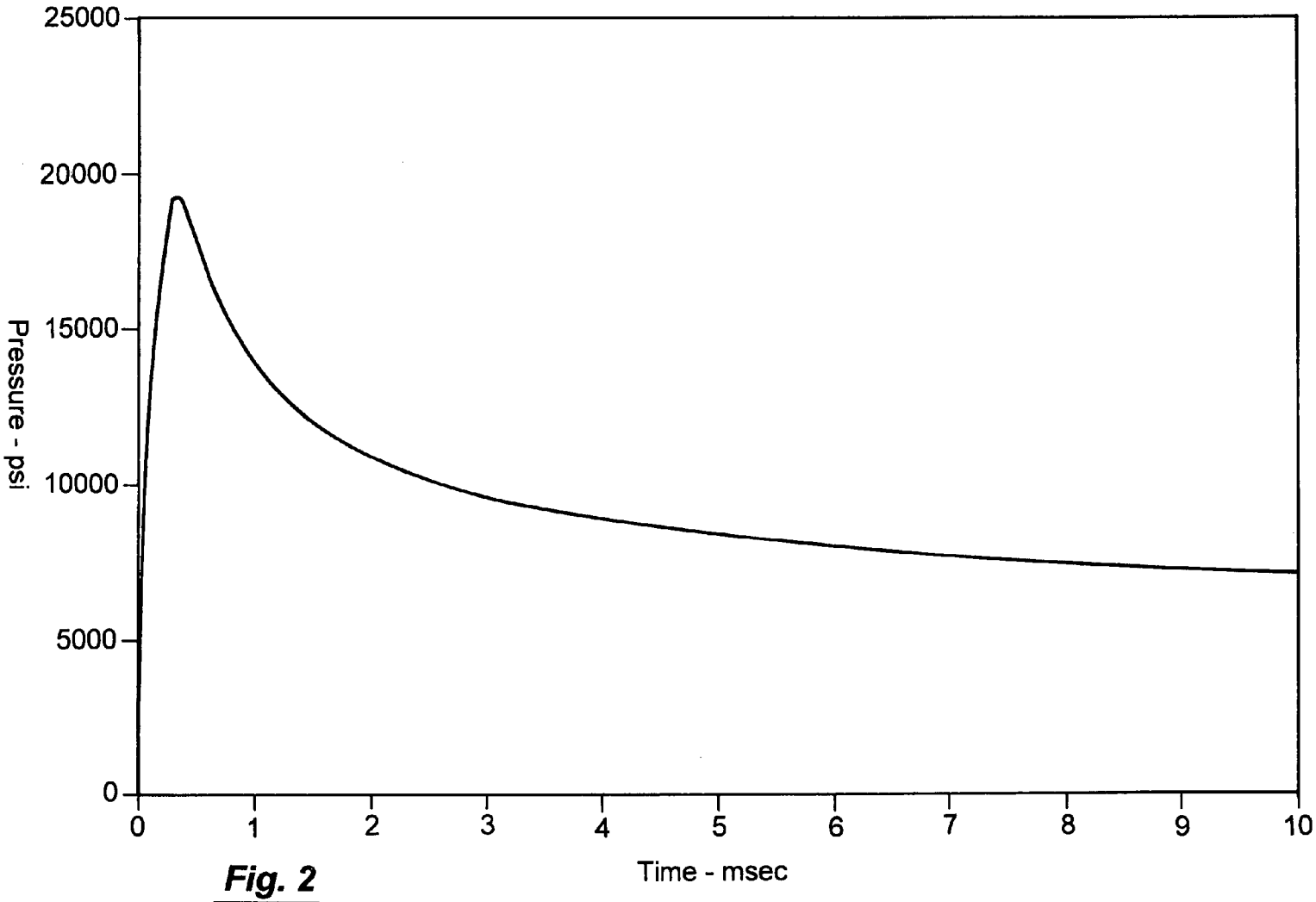
FIG. 2 is a graph illustrating the pressure produced by the primary and supplemental propellant charges within the well as a function of time.

Various means of ignition are currently in place to begin the ignition process. Ignition of the primary propellant charge 10 adjacent to the perforated zone in the well is accomplished either through the use of: (1) electric blasting caps and transfer line to ignite a mild detonating cord that ignites the primary propellant 10; (2) a mechanical bar drop firing head which ignites an initiator and a booster, transfer line and then the mild detonating cord; or (3) a timed electronic device above the primary propellant charge 10 for ignition. Alternatively, the primary propellant charge 10 can be ignited using an absolute value pressure head in place of the crossover 50 at the top of the primary propellant 10. The primary propellant 10 burns radially which gives a short burn time (e.g., approximately 1 second), as illustrated in FIG. 2.

The supplemental propellant grains 20 are ignited sympathetically from the hot gases produced by the combustion of the primary propellant charge. The ignition of the supplemental propellant grains 20 occurs only at the ends that are closest to the primary propellant charge 10. An inhibitor 22 fixed to the supplemental propellant surface prevents its ignition along the radial surface and consequently produces the desired long burn time (i.e., the burn distance is the length of the propellant as opposed to its radius, a ratio on the order of 100). The ported crossovers 30 at the ends nearest the primary propellant 10 are the only place for the combustion gases from the supplemental propellant grains 20 to escape since the supplemental propellant carriers 25 have not been ported. Therefore the combustion gases have to exit via perforations in the primary propellant carrier 15, adjacent to the casing perforations.

The supplemental propellant grains 20 employ an end burn that causes burn times to be much longer and in some cases longer than required. The propellant burn rate can be increased (i.e., for shorter total burn times) to the appropriate value by using mechanical or chemical burn rate enhancers, or by varying the configuration of the propellant tools. For example, a number of thermally-conductive wires can be embedded in the supplemental propellant grains 20 parallel to the burn axis to increase the burn rate. In other applications, it may be desirable to decrease the burn rate (i.e., to lengthen the total burn times). This is be accomplished, for example, by adding a retardant to the supplemental propellant grains 20. One alternative would be to increase the concentration of polyvinyl chloride (PVC) binder used to form the supplemental propellant grains 20.

Figure 3:
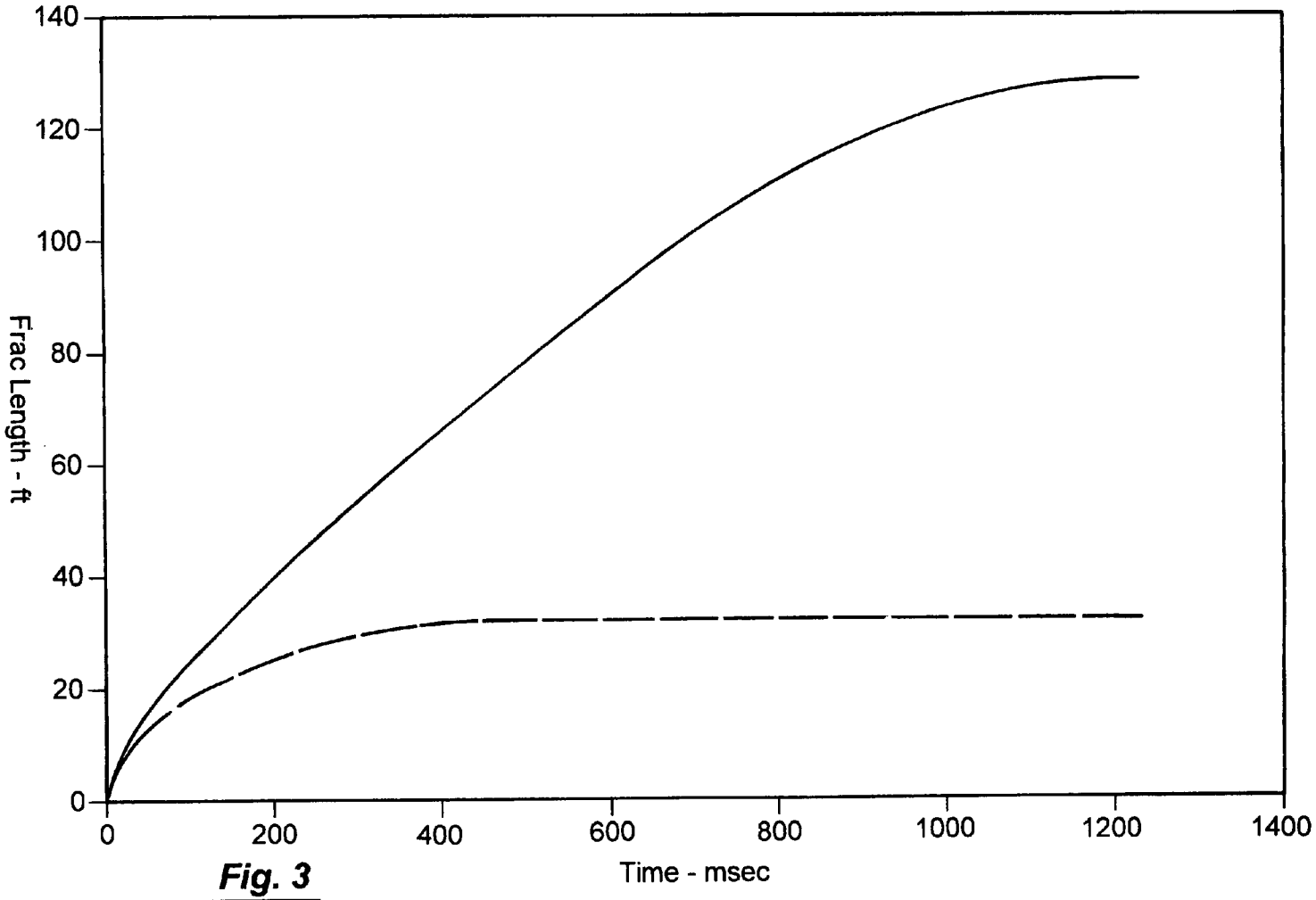
FIG. 3 is a graph from a computer simulation illustrating the fracture length as a function of time resulting from the present invention in comparison to the fracture length resulting from a single propellant charge.

As shown in the graph provided in FIG. 2, the supplemental propellant grains 20 produce gas at a rate that keeps the pressure above the maximum fracture extension pressure but below that which would cause casing damage. This allows fractures to continue their extension into the formation for times that are much longer than for a single propellant grain, thus increasing the effective fracture lengths and the corresponding effective well bore diameters. FIG. 3 is a graph from a computer simulation illustrating the fracture length as a function of time resulting from the present invention in comparison to the fracture length resulting from a single propellant charge.

A computer program can be used to model combustion of the propellant grains to predict the resulting generation of combustion gases and fracture propagation, and thereby determine a suitable quantity and configuration of the propellant for fracture propagation in the surrounding formation. For example, the combustion and fracturing processes can be modeled using computer software similar to that described in U.S. Pat. No. 5,295,545 (Passamaneck).

FIG. 1 shows an embodiment of the present invention using two supplemental propellant grains 20 located above and below the primary propellant 10. It should be expressly understood that any desired number of supplemental propellant grains 20 could be employed in series, and that the dimensions, configurations, and compositions of the supplemental propellant grains 20 is entirely within the discretion of the designer to meet the needs of a particular well.

The above disclosure sets forth a number of embodiments of the present invention. Other arrangements or embodiments, not precisely set forth, could be practiced under the teachings of the present invention and as set forth in the following claims.

We claim:

1. An apparatus for creating fractures in the geological formation surrounding a well comprising:

a primary propellant charge burned for approximately 400 milliseconds to 1 second to generate combustion gases at a rate sufficient to produce pressures within the well in excess of the maximum fracture extension pressure of the surrounding formation, but below a pressure that would cause damage to the well; and a supplemental propellant charge burned for a substantially longer period of time than the primary propellant charge, but maintaining pressures within the well in excess of the maximum fracture extension pressure of the surrounding formation for a significant period of time following completion of the primary propellant burn.

2. The apparatus of claim 1 wherein the supplemental propellant charge burns for less than 20 seconds.

3. The apparatus of claim 1 wherein the supplemental propellant charge is ignited by the combustion of the primary propellant charge.

4. The apparatus of claim 1 wherein the supplemental propellant charge burns axially from an end.

5. The apparatus of claim 1 wherein the supplemental propellant charge further comprises a retardant.

6. The apparatus of claim 1 further comprising an ignition inhibitor on the radial surface of the supplemental propellant charge.

7. The apparatus of claim 1 wherein the surface of the primary propellant charge is ignited and burns radially inward.

8. A method for creating fractures in the geological formation surrounding a well comprising:

burning a primary propellant charge in the well for approximately 400 milliseconds to 1 second to generate combustion gases at a rate sufficient to produce pressures within the well in excess of the maximum fracture extension pressure of the surrounding formation, but below a pressure that would cause damage to the well; and burning a supplemental propellant charge in the well for a substantially longer period of time than the primary propellant charge, but maintaining pressures within the well in excess of the maximum fracture extension pressure of the surrounding formation for a significant period of time following completion of the primary propellant burn.

9. The method of claim 8 wherein the supplemental propellant charge burns for less than 20 seconds.

10. The method of claim 8 wherein the supplemental propellant charge is ignited by the combustion of the primary propellant charge.

11. The method of claim 8 wherein the supplemental propellant charge burns axially from an end.

12. An apparatus for creating fractures in the geological formation surrounding a well comprising:

a primary propellant charge burned for approximately 400 milliseconds to 1 second to generate combustion gases at a rate sufficient to produce pressures within the well in excess of the maximum fracture extension pressure of the surrounding formation, but below a pressure that would cause damage to the well; and a supplemental propellant charge having an end adjacent to the primary propellant charge that is ignited by the combustion of the primary propellant charge and burns axially to generate combustion gases for a substantially longer period of time than the primary propellant charge, but maintains pressures within the well in excess of the maximum fracture extension pressure of the surrounding formation for a significant period of time following completion of the primary propellant burn.

13. The apparatus of claim 12 wherein the supplemental propellant charge burns for less than 20 seconds.

14. The apparatus of claim 12 further comprising two supplemental propellant charges placed above and below the primary propellant charge, and wherein the adjacent ends of both supplemental propellant charges are ignited by the primary propellant charge.

15. The apparatus of claim 12 wherein the supplemental propellant charge further comprises a retardant.

16. The apparatus of claim 12 further comprising an ignition inhibitor on the radial surface of the supplemental propellant charge.

17. The apparatus of claim 12 wherein the surface of the primary propellant charge is ignited and burns radially inward.

* * * * *